US006726530B2

(12) United States Patent
Mikhaylich et al.

(10) Patent No.: US 6,726,530 B2
(45) Date of Patent: Apr. 27, 2004

(54) END-POINT DETECTION SYSTEM FOR CHEMICAL MECHANICAL POLISHING APPLICATIONS

(75) Inventors: Katrina A. Mikhaylich, San Jose, CA (US); Mike Ravkin, Sunnyvale, CA (US); Yehiel Gotkis, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 201 days.

(21) Appl. No.: 10/052,769

(22) Filed: Jan. 17, 2002

(65) Prior Publication Data

US 2002/0061713 A1 May 23, 2002

Related U.S. Application Data

(62) Division of application No. 09/608,242, filed on Jun. 30, 2000, now Pat. No. 6,375,540.

(51) Int. Cl.[7] ..... B24B 49/14
(52) U.S. Cl. ..... 451/8; 451/53
(58) Field of Search ..... 451/8, 6, 41, 296, 451/307, 7, 5, 53

(56) References Cited

U.S. PATENT DOCUMENTS

| | | | | |
|---|---|---|---|---|
| 5,597,442 A | | 1/1997 | Chen et al. | 156/626.1 |
| 5,643,050 A | * | 7/1997 | Chen | 451/6 |
| 5,647,952 A | * | 7/1997 | Chen | 156/636.1 |
| 6,007,408 A | | 12/1999 | Sandhu | 451/41 |
| 6,153,116 A | | 11/2000 | Yang et al. | 216/85 |
| 6,186,865 B1 | * | 2/2001 | Thornton et al. | 451/307 |
| 6,224,461 B1 | * | 5/2001 | Boehm, Jr. et al. | 451/307 |
| 6,325,706 B1 | * | 12/2001 | Krusell et al. | 451/307 |

FOREIGN PATENT DOCUMENTS

| | | | |
|---|---|---|---|
| EP | 0 616 362 A2 | 9/1994 | H01L/21/461 |
| JP | 9-148281 | 6/1997 | H01L/21/304 |
| JP | 2000-340538 | 12/2000 | H01L/21/304 |

* cited by examiner

*Primary Examiner*—Robert A. Rose
(74) *Attorney, Agent, or Firm*—Martine & Penilla, LLP

(57) ABSTRACT

Chemical mechanical polishing systems and methods are disclosed. The system includes a polishing pad that is configured to move from a first point to a second point. A carrier is also included and is configured to hold a substrate to be polished over the polishing pad. The carrier is designed to apply the substrate to the polishing pad in a polish location that is between the first point and the second point. A first sensor is located at the first point and oriented so as to sense an IN temperature of the polishing pad, and a second sensor is located a the second point and oriented so as to sense an OUT temperature of the polishing pad. The sensing of the IN and OUT temperatures is configured to produce a temperature differential that allows monitoring the process state and the state of the wafer surface for purposes of switching the process steps while processing wafers by chemical mechanical planarization.

13 Claims, 10 Drawing Sheets

450

| ZONES | $T_{in}$ | $T_{out}$ | $\Delta T$ | TARGET $\Delta T$ FOR END-POINT |
|---|---|---|---|---|
| ZONE 1 | 9 | 10 | $\Delta T_1$ | 15 |
| ZONE 2 | 5 | 6 | $\Delta T_2$ | 20 |
| ZONE 3 | 1 | 2 | $\Delta T_3$ | 35 |
| ZONE 4 | 3 | 4 | $\Delta T_4$ | 20 |
| ZONE 5 | 7 | 8 | $\Delta T_5$ | 15 |

END-POINT DETECTION SYSTEM FOR CHEMICAL MECHANICAL POLISHING APPLICATIONS

This is a Divisional application Ser. No. 09/608,242 filed on Jun. 30, 2000 now U.S. Pat. No. 6,375,540,

BACKGROUND OF THE INVENTION

1. Field of the Invention

The present invention relates generally to the chemical mechanical polishing (CMP) of semiconductor wafers, and more particularly, to techniques for polishing end-point detection.

2. Description of the Related Art

In the fabrication of semiconductor devices, there is a need to perform CMP operations, including polishing, buffing and wafer cleaning. Typically, integrated circuit devices are in the form of multi-level structures. At the substrate level, transistor devices having diffusion regions are formed. In subsequent levels, interconnect metallization lines are patterned and electrically connected to the transistor devices to define the desired functional device. As is well known, patterned conductive layers are insulated from other conductive layers by dielectric materials, such as silicon dioxide. At each metallization level there is a need to planarize metal or associated dielectric material. Without planarization, fabrication of additional metallization layers becomes substantially more difficult due to the higher variations in the surface topography. In other applications, metallization line patterns are formed in the dielectric material, and then metal CMP operations are performed to remove excess metallization, e.g., such as copper.

In the prior art, CMP systems typically implement belt, orbital, or brush stations in which belts, pads, or brushes are used to scrub, buff, and polish a wafer. Slurry is used to facilitate and enhance the CMP operation. Slurry is most usually introduced onto a moving preparation surface, e.g., belt, pad, brush, and the like, and distributed over the preparation surface as well as the surface of the semiconductor wafer being buffed, polished, or otherwise prepared by the CMP process. The distribution is generally accomplished by a combination of the movement of the preparation surface, the movement of the semiconductor wafer and the friction created between the semiconductor wafer and the preparation surface.

FIG. 1A shows a cross sectional view of a dielectric layer 102 undergoing a fabrication process that is common in constructing damascene and dual damascene interconnect metallization lines. The dielectric layer 102 has a diffusion barrier layer 104 deposited over the etch-patterned surface of the dielectric layer 102. The diffusion barrier layer, as is well known, is typically titanium nitride (TiN), tantalum (Ta), tantalum nitride (TaN) or a combination of tantalum nitride (TaN) and tantalum (Ta). Once the diffusion barrier layer 104 has been deposited to the desired thickness, a copper layer 104 is formed over the diffusion barrier layer in a way that fills the etched features in the dielectric layer 102. Some excessive diffusion barrier and metallization material is also inevitably deposited over the field areas. In order to remove these overburden materials and to define the desired interconnect metallization lines and associated vias (not shown), a chemical mechanical planarization (CMP) operation is performed.

As mentioned above, the CMP operation is designed to remove the top metallization material from over the dielectric layer 102. For instance, as shown in FIG. 1B, the overburden portion of the copper layer 106 and the diffusion barrier layer 104 have been removed. As is common in CMP operations, the CMU operation must continue until all of the overburden metallization and diffusion barrier material 104 is removed from over the dielectric layer 102. However, in order to ensure that all the diffusion barrier layer 104 is removed from over the dielectric layer 102, there needs to be a way of monitoring the process state and the state of the wafer surface during its CMP processing. This is commonly referred to as end-point detection. In multi-step CMP operations there is a need to ascertain multiple end-points (e.g., such as to ensure that Cu is removed from over the diffusion barrier layer; and to ensure that the diffusion barrier layer is removed from over the dielectric layer). Thus, end-point detection techniques are used to ensure that all of the desired overburden material is removed. A common problem with current end-point detection techniques is that some degree of over-etching is required to ensure that all of the conductive material (e.g., metallization material or diffusion barrier layer 104) is removed from over the dielectric layer 102 to prevent inadvertent electrical interconnection between metallization lines. A side effect of improper end-point detection or over-polishing is that dishing 108 occurs over the metallization layer that is desired to remain within the dielectric layer 102. The dishing effect essentially removes more metallization material than desired and leaves a dish-like feature over the metallization lines. Dishing is known to impact the performance of the interconnect metallization lines in a negative way, and too much dishing can cause a desired integrated circuit to fail for its intended purpose.

FIG. 1C shows a prior art belt CMP system in which a pad 150 is designed to rotate around rollers 151. As is common in belt CMP systems, a platen 154 is positioned under the pad 150 to provide a surface onto which a wafer will be applied using a carrier 152 as shown in FIG. 1B. One way of performing end-point detection is to use an optical detector 160 in which light is applied through the platen 154, through the pad 150 and onto the surface of the wafer 100 being polished. In order to accomplish optical end-point detection, a pad slot 150*a* is formed into the pad 150. In some embodiments, the pad 150 may include a number of pad slots 150*a* strategically placed in different locations of the pad 150. Typically, the pad slots 150*a* are designed small enough to minimize the impact on the polishing operation. In addition to the pad slot 150*a*, a platen slot 154*a* is defined in the platen 154. The platen slot 154*a* is designed to allow the optical beam to be passed through the platen 154, through the pad 150, and onto the desired surface of the wafer 100 during polishing.

By using the optical detector 160, it is possible to ascertain a level of removal of certain films from the wafer surface. This detection technique is designed to measure the thickness of the film by inspecting the interference patterns received by the optical detector 160. Although optical end-point detection is suitable for some applications, optical end-point detection may not be adequate in cases where end-point detection is desired for different regions or zones of the semiconductor wafer 100. In order to inspect different zones of the wafer 100, it is necessary to define several pad slots 150*a* as well as several platen slots 154*a*. As more slots are defined in the pad 150 and the platen 154, there may be a greater detrimental impact upon the polishing being performed on the wafer 100. That is, the surface of the pad 150 will be altered due to the number of slots formed into the pad 150 as well as complicating the design of the platen 154.

Additionally, conventional platens 154 are designed to strategically apply certain degrees of back pressure to the pad 150 to enable precision removal of the layers from the wafer 100. As more platen slots 154*a* are defined into the platen 154, it will be more difficult to design and implement pressure applying platens 154. Accordingly, optical end-point detection is generally complex to integrate into a belt CMP system and also poses problems in the complete detection of end-point throughout different zones or regions of a wafer without impacting the CMP system's ability to precision polish layers of the wafer.

FIG. 2A shows a partial cross-sectional view of an exemplary semiconductor chip 201 after the top layer has undergone a copper CMP process. Using standard impurity implantation, photolithography, and etching techniques, P-type transistors and N-type transistors are fabricated into the P-type silicon substrate 200. As shown, each transistor has a gate, source, and drain, which are fabricated into appropriate wells. The pattern of alternating P-type transistors and N-type transistors creates a complementary metal dielectric semiconductor (CMOS) device.

A first dielectric layer 202 is fabricated over the transistors and substrate 200. Conventional photolithography, etching, and deposition techniques are used to create tungsten plugs 210 and copper lines 212. The tungsten plugs 210 provide electrical connections between the copper lines 212 and the active features on the transistors. A second dielectric layer 204 may be fabricated over the first dielectric layer 202 and copper lines 212. Conventional photolithography, etching, and deposition techniques are used to create copper vias 220 and copper lines 214 in the second dielectric layer 204. The copper vias 220 provide electrical connections between the copper lines 214 in the second layer and the copper lines 212 or the tungsten plugs 210 in the first layer.

The wafer then typically undergoes a copper CMP process to planarize the surface of the wafer as described with reference to FIGS. 1A–1D, leaving an approximately flat surface (with possible dishing, not shown here, but illustrated with reference to FIG. 1B). After the copper CMP process, the wafer is cleaned in a wafer cleaning system.

FIG. 2B shows the partial cross-sectional view after the wafer has undergone optical end-point detection as discussed with reference to FIGS. 1C and 1D. As shown, the copper lines 214 on the top layer have been subjected to photo-corrosion during the detection process. The photo-corrosion is believed to be partially caused by light photons emitted by the optical detector and reach the P/N junctions, which can act as solar cells. Unfortunately, this amount of light, which is generally normal for optical detection can cause a catastrophic corrosion effect.

In this cross-sectional example, the copper lines, copper vias, or tungsten plugs are electrically connected to different parts of the P/N junction. The slurry chemicals and/or chemical solutions applied to the wafer surface, can include electrolytes, which have the effect of closing an electrical circuit as electrons $e^-$ and holes $h^+$ are transferred across the P/N junctions. The electron/hole pairs photo-generated in the junction are separated by the electrical field. The introduced carriers induce a potential difference between the two sides of the junction. This potential difference increases with light intensity. Accordingly, at the electrode connected to the P-side of the junction, the copper is corroded: $Cu \rightarrow Cu^{2+} + 2e^-$. The produced soluble ionic species can diffuse to the other electrode, where the reduction can occur: $Cu^{2+} + 2e^- \rightarrow Cu$. Note that the general corrosion formula for any metal is $M \rightarrow M^{n+} + ne^-$, and the general reduction formula for any metal is $M^{n+} + ne^- \rightarrow M$. For more information on photo-corrosion effects, reference can be made to an article by A. Beverina et al., "Photo-Corrosion Effects During Cu Interconnection Cleanings," to be published in the 196$^{th}$ *ECS Meeting,* Honolulu, Hi. (October 1999). This article is hereby incorporated by reference.

Unfortunately, this type of photo-corrosion displaces the copper lines and destroys the intended physical topography of the copper features, as shown in FIG. 2B. At some locations on the wafer surface over the P-type transistors, the photo-corrosion effect may cause corroded copper lines 224 or completely dissolved copper lines 226. In other words, the photo-corrosion may completely corrode the copper line such that the line no longer exists. On the other hand, over the N-type transistors, the photo-corrosion effect may cause copper deposit 222 to be formed. This distorted topography, including the corrosion of the copper lines, may cause device defects that render the entire chip inoperable. One defective device means the entire chip must be discarded, thus, decreasing yield and drastically increasing the cost of the fabrication process. This effect, however, will generally occur over the entire wafer, thus destroying many of the chips on the wafer. This, of course, increases the cost of fabrication.

In view of the foregoing, there is a need for CMP end-point detection systems that do not implement optical detectors and enable precision end-point detection to prevent dishing and avoid the need to perform excessive over-polishing.

SUMMARY OF THE INVENTION

Broadly speaking, the present invention fills these needs by providing end-point detection systems and methods to be used in the chemical mechanical polishing of substrate surface layers. It should be appreciated that the present invention can be implemented in numerous ways, including as a process, an apparatus, a system, a device or a method. For example, the present invention can be used with linear belt pad systems, rotary pad systems, as well as orbital pad systems. Several inventive embodiments of the present invention are described below.

In one embodiment, a chemical mechanical polishing system is disclosed. The system includes a polishing pad that is configured to move linearly from a first point to a second point. A carrier is also included and is configured to hold a substrate to be polished over the polishing pad. The carrier is designed to apply the substrate to the polishing pad in a polish location that is between the first point and the second point. A first sensor is located at the first point and oriented so as to sense an IN temperature of the polishing pad, and a second sensor is located a the second point and oriented so as to sense an OUT temperature of the polishing pad. The sensing of the IN and OUT temperatures is configured to produce a temperature differential that when changed indicates a removal of a desired layer from the substrate.

In another embodiment, a method for monitoring end-point for chemical mechanical polishing is disclosed. The method includes providing a polishing pad belt that is configured to move linearly, and applying a wafer to the polishing pad belt at a polishing location so as to remove a first layer of material from the wafer. The method further includes sensing a first temperature of the polishing pad belt at an IN location that is linearly before the polishing location and sensing a second temperature of the polishing pad belt at an OUT location that is linearly after the polishing location. Then, a temperature differential is calculated between the second temperature and the first temperature. A change in the temperature differential is then monitored, such that the change in temperature differential is indicative of a removal of the first layer from the wafer. Wherein the first layer can be any layer that is fabricated over a wafer, such as dielectric, copper, diffusion barrier layers, etc.

In still another embodiment, a method for monitoring an end-point of material removal from a wafer surface is disclosed. The method includes: (a) providing a polishing pad that is configured to move linearly; (b) applying a wafer to the polishing pad at a polishing location so as to remove a layer of material from the wafer; (c) sensing a first temperature of the polishing pad at a first location that is before the polishing location; (d) sensing a second temperature of the polishing pad at a second location that is after the polishing location; and (e) calculating a temperature differential between the second temperature and the first temperature.

In another embodiment, an end-point detection method is disclosed. The method includes: (a) providing a polishing pad; (b) applying a wafer to the polishing pad at a polishing location so as to remove a first layer of material from the wafer; (c) sensing a first temperature of the polishing pad at an IN location that is before the polishing location; (d) sensing a second temperature of the polishing pad at an OUT location that is after the polishing location; (e) calculating a temperature differential between the second temperature and the first temperature; and (f) monitoring a change in the temperature differential, the change being indicative of a removal of the first layer from the wafer. Wherein, the pad is one of a belt pad, a table pad, a rotary pad, and an orbital pad.

Other aspects and advantages of the present invention will become apparent from the following detailed description, taken in conjunction with the accompanying drawings, illustrating by way of example the principles of the present invention.

BRIEF DESCRIPTION OF THE DRAWINGS

The present invention will be readily understood by the following detailed description in conjunction with the accompanying drawings, in which like reference numerals designate like structural elements.

DETAILED DESCRIPTION OF THE PREFERRED EMBODIMENTS

An invention for chemical mechanical polishing (CMP) end-point detection systems and methods for implementing such systems are disclosed. In the following description, numerous specific details are set forth in order to provide a thorough understanding of the present invention. It will be understood, however, to one skilled in the art, that the present invention may be practiced without some or all of these specific details. In other instances, well known process operations have not been described in detail in order not to unnecessarily obscure the present invention.

Figure 1A:
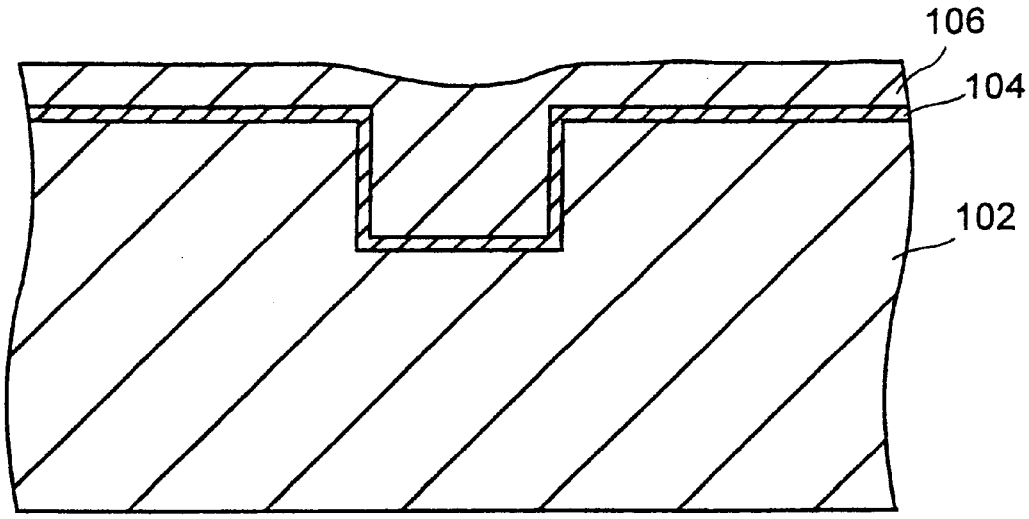
FIG. 1A (prior art)
FIGS. 1A and 1B show a cross sectional view of a dielectric layer undergoing a fabrication process that is common in constructing damascene and dual damascene interconnect metallization lines and structures.
Figure 1B:
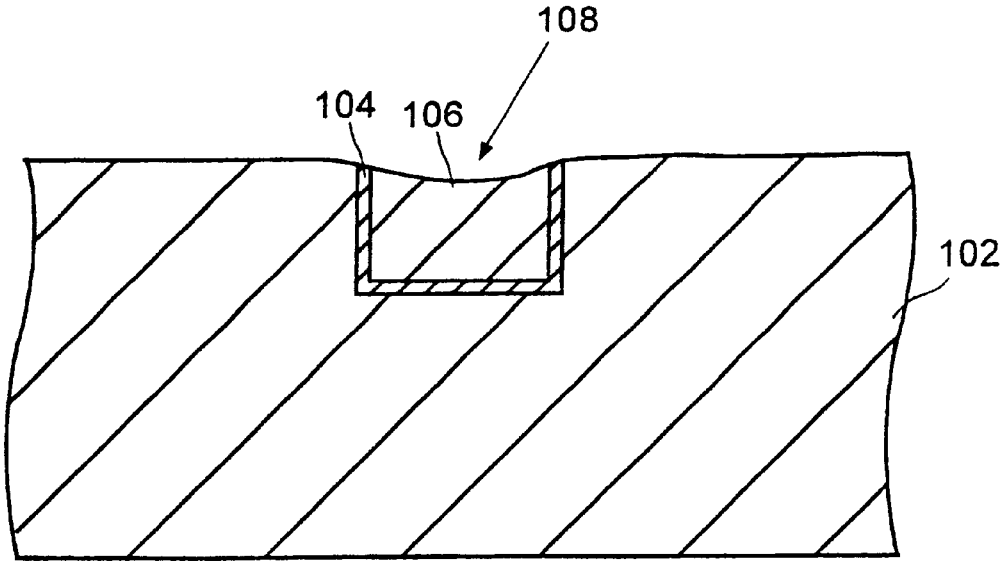
FIG. 1B (prior art)
Figure 1C:
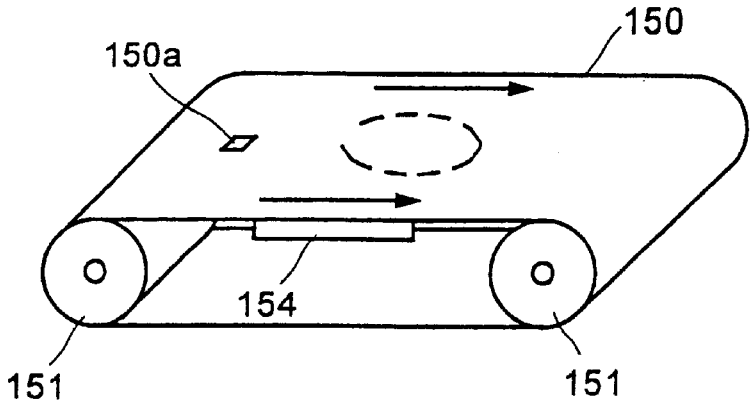
FIG. 1C (prior art)
FIGS. 1C and 1D shows a prior art belt CMP system in which a pad is designed to rotate around rollers and an optical end-point detection system is used.
Figure 1D:
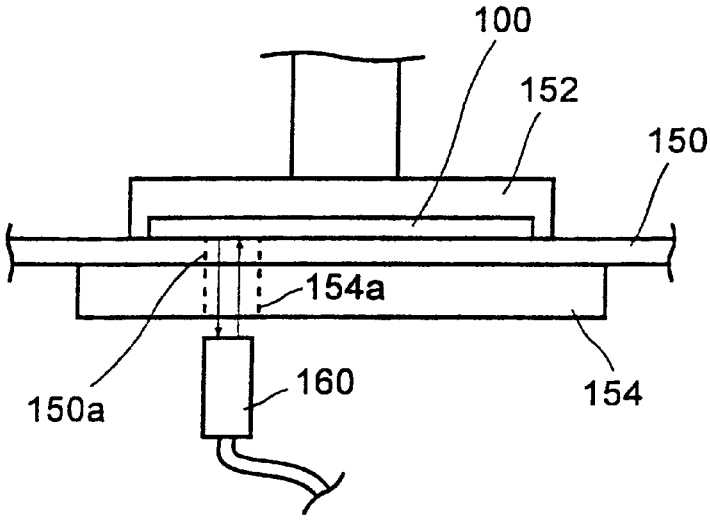
FIG. 1D (prior art)
Figure 2A:
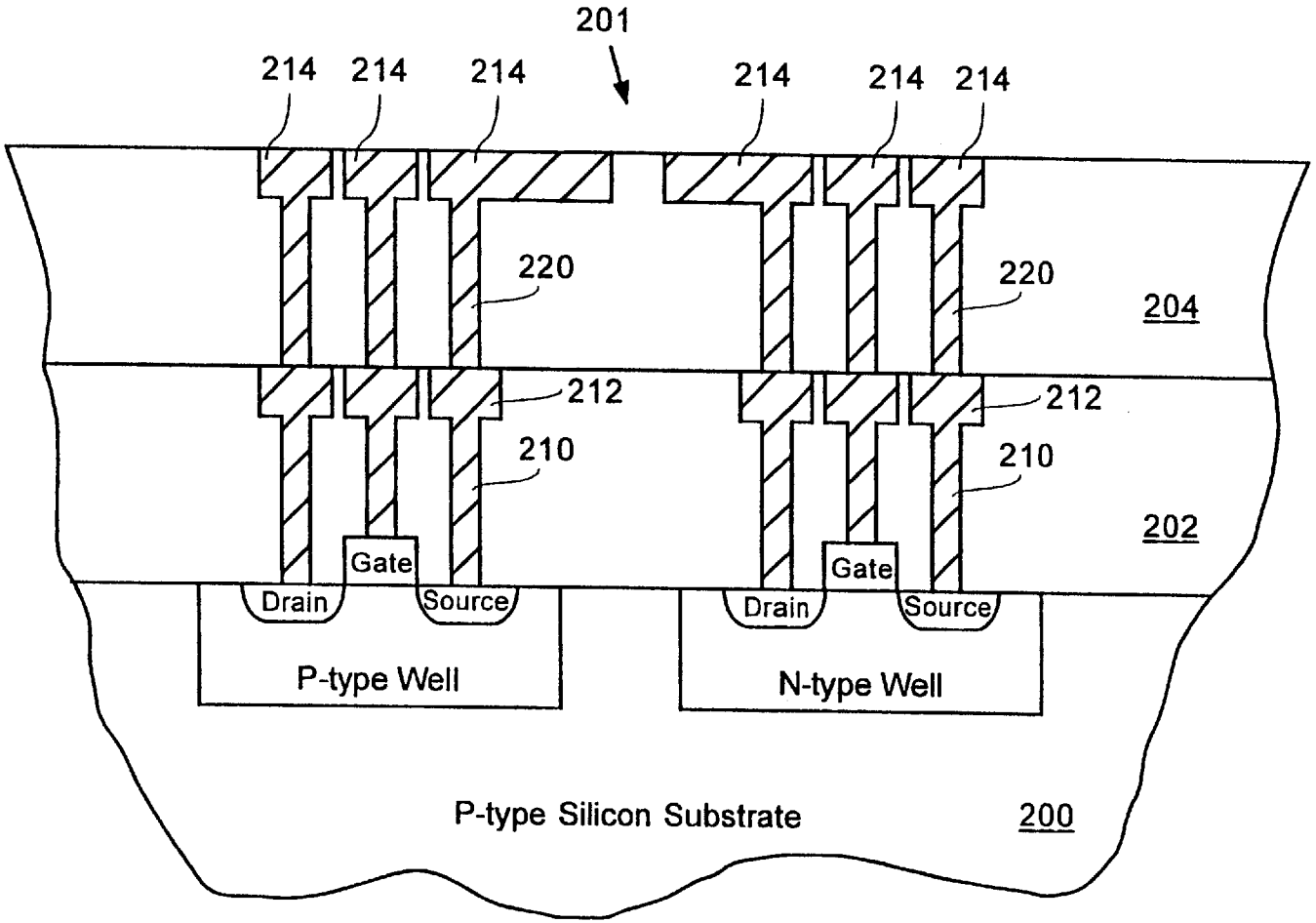
FIG. 2A (prior art)
FIG. 2A shows a cross-sectional view of a conventional semiconductor chip after the top layer has undergone a copper CMP process.
Figure 2B:
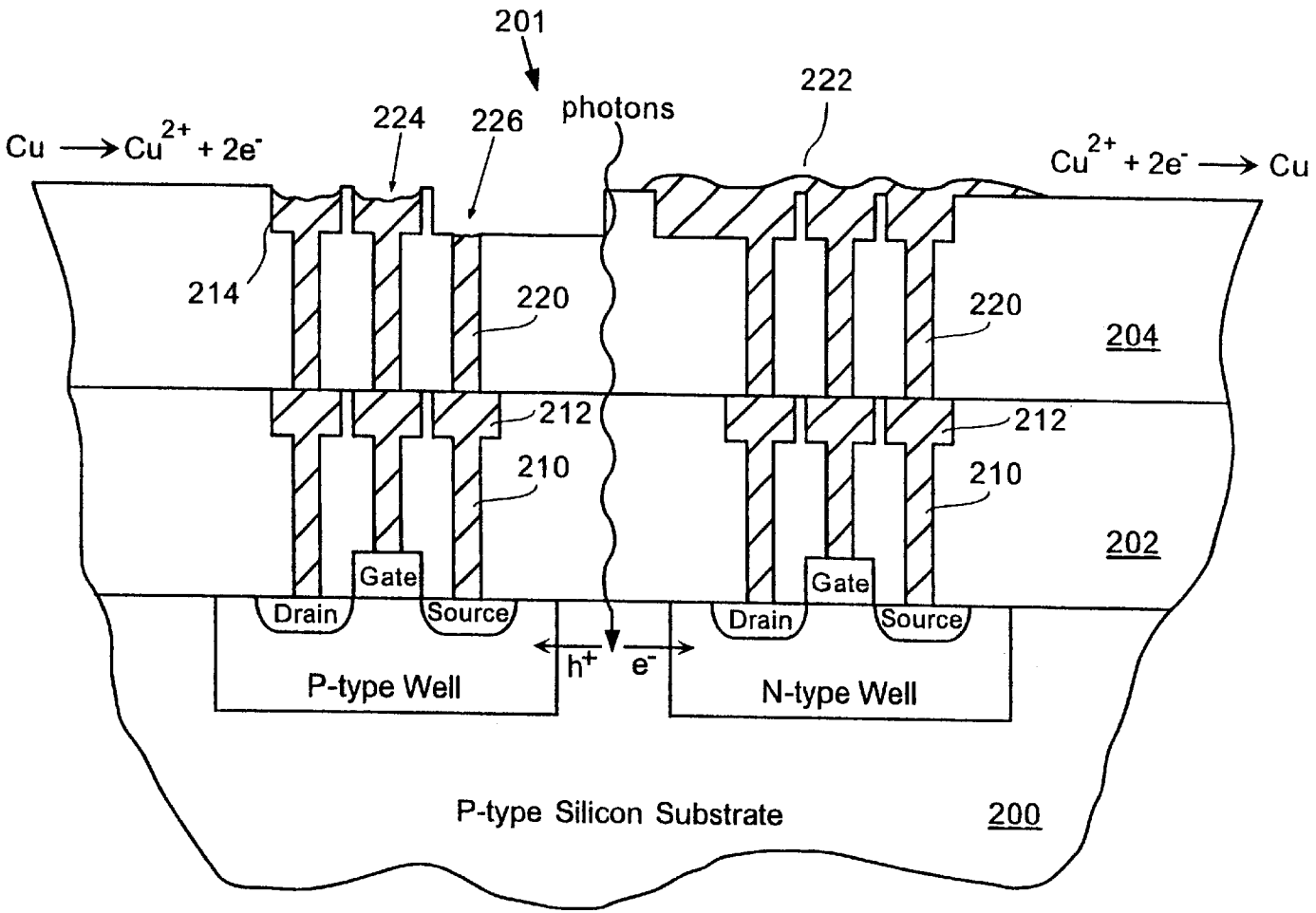
FIG. 2B (prior art)
FIG. 2B shows a cross-sectional view of the conventional semiconductor chip of FIG. 2A after the wafer has undergone through photo-assisted corrosion due to, for example, optical end-point detection.
Figure 3A:
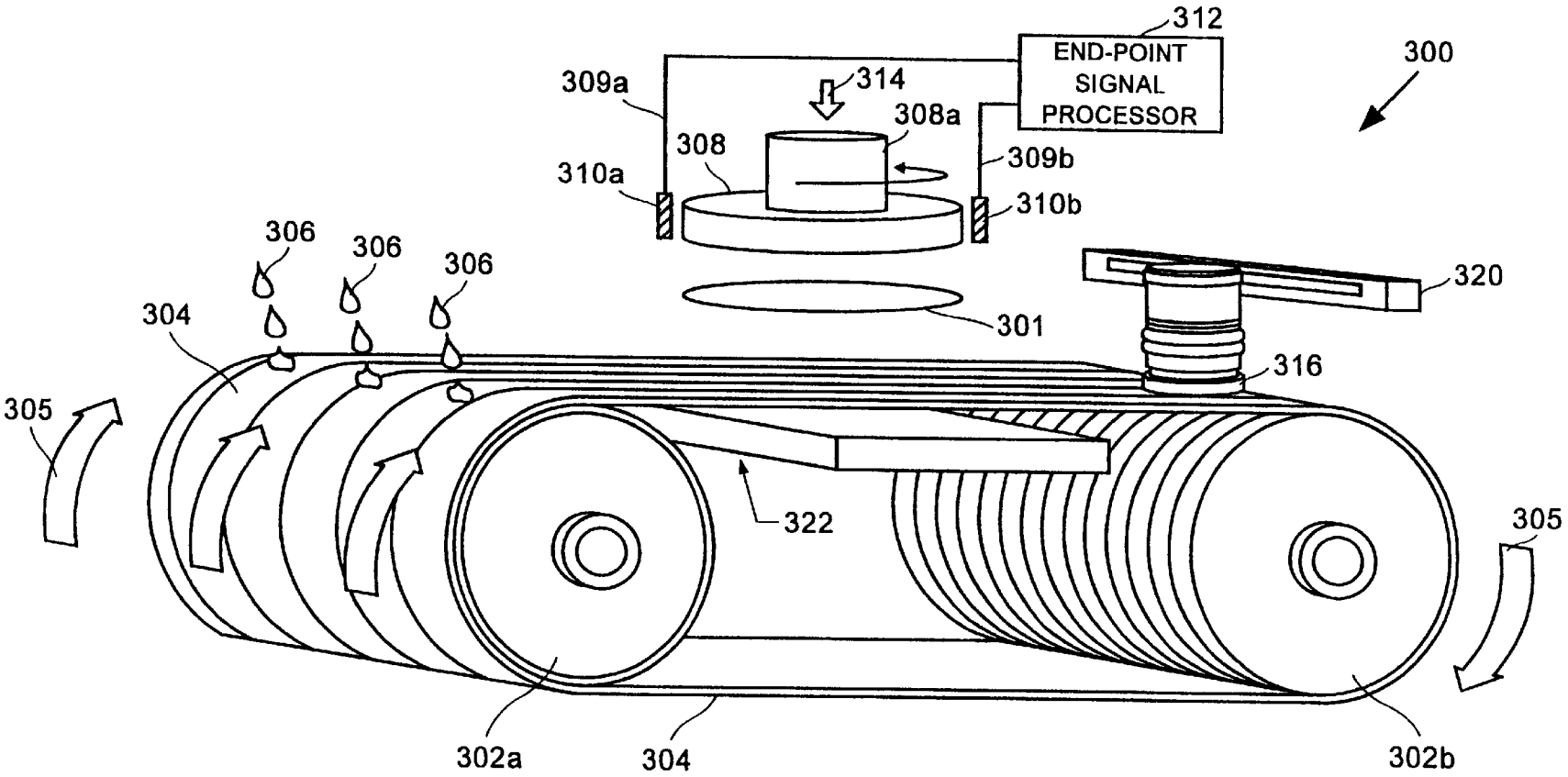
FIG. 3A shows a CMP system including an end-point detection system, in accordance with one embodiment of the present invention.

FIG. 3A shows a CMP system 300 including an end-point detection system, in accordance with one embodiment of the present invention. The end-point detection system is designed to include sensors 310*a* and 310*b* positioned near a location that is proximate to a carrier 308. As is well known, the carrier 308 is designed to hold a wafer 301 and apply the wafer 301 to the surface of a pad 304. The pad 304 is designed to move in a pad motion direction 305 around rollers 302*a* and 302*b*. The pad 304 is generally provided with slurry 306 that assists in the chemical mechanical polishing of the wafer 301. In this embodiment, the CMP system 300 also includes a conditioning head 316 that is connected to a track 320. The conditioning head is designed to scrub the surface of the pad 304 either in an in-situ manner or an ex-situ manner. As is well known, the conditioning of the pad 304 is designed to re-condition the surface of the pad 304 to improve the performance of the polishing operations.

The sensors 310*a* and 310*b* are designed to be fixed over a location of the pad 304, while the carrier 308 rotates the wafer 301 over the surface of the pad 304. Accordingly, the sensors 310*a* and 310*b* will not rotate with the carrier 308, but will remain at a same approximate location over the platen 322. The sensors 310*a* and 310*b* are preferably temperature sensors which sense the temperature of the pad 304 during a CMP operation. The sensed temperature is then provided to sensing signals 309*a* and 309*b* which are communicated to an end-point signal processor 312. As shown, the carrier 308 also has a carrier positioner 308*a* which is designed to lower and raise the carrier 308 and associated wafer 301 over the pad 304 in the direction 314.

Figure 3B:
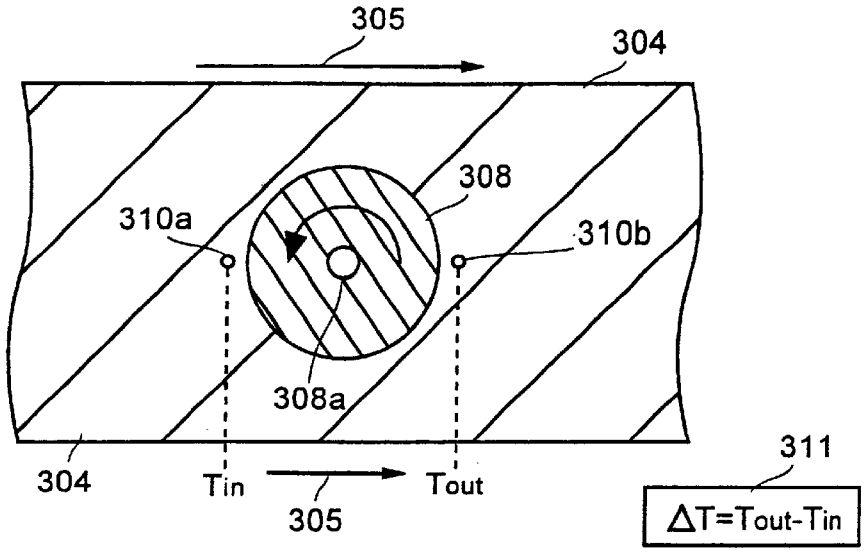
FIG. 3B shows a top view of a portion of a pad that is moving linearly.
Figure 3C:
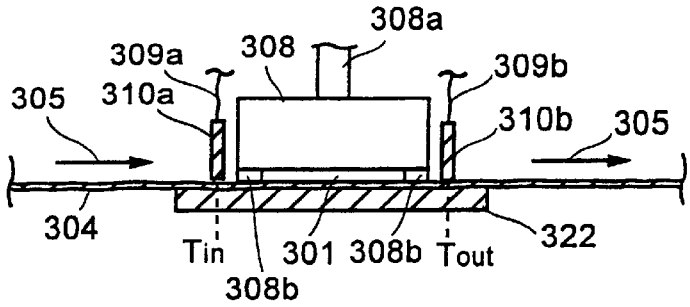
FIG. 3C illustrates a side view of a carrier applying a wafer to a pad.
Figure 3D:
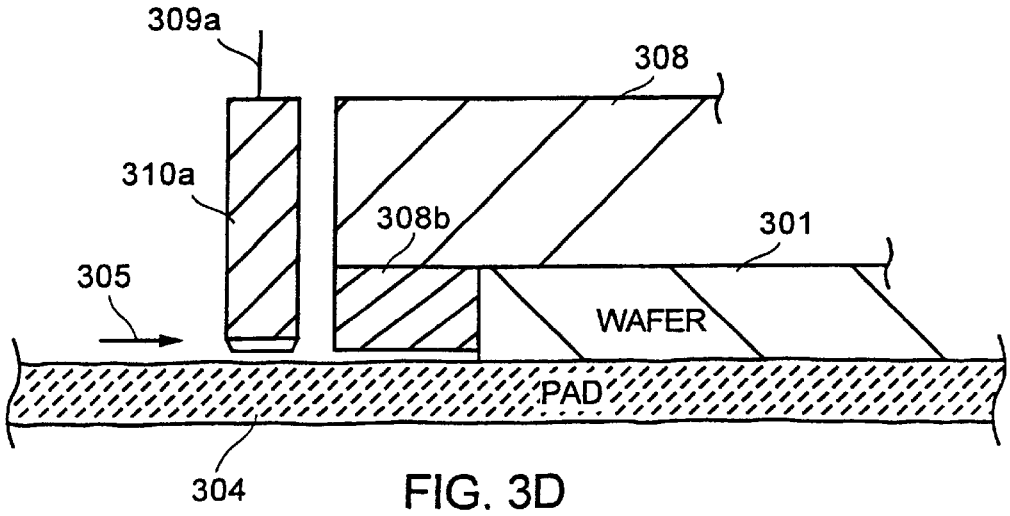
FIG. 3D is a more detailed view of FIG. 3C.

FIG. 3B shows a top view of a portion of a pad 304 that is moving in the motion direction 305. As shown, the carrier 308 is lowered by the carrier positioner 308*a* onto the pad 304. The sensors 310*a* and 310*b* are also lowered toward the pad 304 as shown in FIGS. 3C and 3D. The sensors 310*a* and

310*b*, as described above, do not rotate with the carrier 308, but remain at the same relative position over the pad 304. Accordingly, the sensors 310*a* and 310*b* are designed to be fixed, however, may move in a vertical direction toward the pad 304 and away from the pad 304 synchronously with the carrier 308. Thus, when the carrier 308 is lowered toward the pad 304, the sensors 310*a* and 310*b* will also be lowered toward the surface of the pad 304. In another embodiment, the carrier 308 can move independently from the sensors 310*a* and 310*b*.

In a preferred embodiment of the present invention, the sensors 310*a* and 310*b* are designed to sense a temperature emanating from the pad 304. Because the wafer, during polishing, is in constant friction with the pad 304, the pad 304 will change in temperature from the time the pad 304 moves from the fixed position of sensor 310*a* and sensor 310*b*. Typically, the heat is absorbed by the wafer, the pad material, outgoing slurry and process by-products. This therefore produces differences in temperature that can be sensed. Thus, the sensed temperature for sensor 310*a* will be a temperature "in" (Tin) and the temperature sensed at sensor 310*b* will be a temperature "out" (Tout). A temperature differential (ΔT) will then be measured by subtracting Tin from Tout. The temperature differential is shown as an equation in box 311 of FIG. 3B.

FIG. 3C illustrates a side view of the carrier 308 applying the wafer 301 to the pad 304. As shown, the carrier 308 applies the wafer 301 that is held by a retaining ring 308*b* against the pad 304 over the platen 322. As the pad 304 moves in the motion direction 305, the sensor 310*a* will detect a temperature Tin that is communicated as a sensing signal 309*a* to the end-point signal processor 312. The sensor 310*b* is also configured to receive a temperature Tout and provide the sensed temperature over a sensing signal 309*b* to the end-point signal to processor 312. In one embodiment, the sensors 310 are preferably positioned proximately to the pad 304 such that the temperature can be sensed accurately enough and provided to the end-point signal processor 312. For example, the sensors are preferably adjusted such that they are between about 1 millimeter and about 250 millimeters from the surface of the pad 304 when the carrier 308 is applying the wafer 301 to the surface of the pad 304. The sensor 310*a* shown in FIG. 3D, in a preferred embodiment, is positioned such that it is about 5 millimeters from the surface of the pad 304.

In this preferred embodiment, the sensors 310 are preferably infrared sensors that are configured to sense the temperature of the pad 304 as the pad moves linearly in the pad motion direction 305. One exemplary infrared temperature sensor is Model No. 39670-10, which is sold by Cole Parmer Instruments, Co. of Vernon Hills, Ill. In another embodiment, the sensors 310 need not necessarily be directly adjacent to the carrier 308. For instance, the sensors can be spaced apart from the carrier 308 at a distance that is between about ⅛ of an inch and about 5 inches, and most preferably positioned at about ¼ inch from the side of the carrier 308. Preferably, the spacing is configured such that the sensors 310 do not interfere with the rotation of the carrier 308 since the sensors 310 are fixed relatively to the pad while the carrier 308 is configured to rotate the wafer 301 up against the pad surface 304.

Figure 4A:
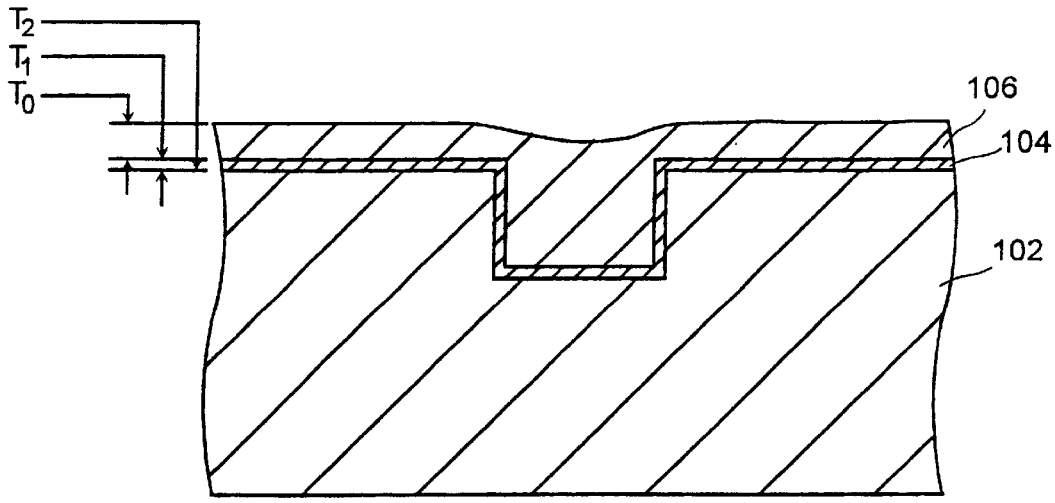
FIG. 4A shows a cross-sectional view of a dielectric layer, a diffusion barrier layer, and a copper layer, each of the copper layer and diffusion barrier layer being configured to be removed during a CMP operation that includes end-point detection, in accordance with one embodiment of the present invention.

FIG. 4A shows a cross-sectional view of the dielectric layer 102, the diffusion barrier layer 104, and the copper layer 106. The thicknesses of the diffusion barrier layer 104 and the copper layer 106 can vary from wafer-to-wafer and surface zone-to-surface zone throughout a particular wafer being polished. However, during a polishing operation, it will take an approximate amount of time to remove the desired amount of material from over the wafer 301. For instance, it will take up to about a time $T_2$ to remove the diffusion barrier layer 104, up to a time $T_1$ to remove the copper 104 down to the diffusion barrier layer 104 relative to a time $T_0$, which is when the polishing operation begins.

Figure 4B:
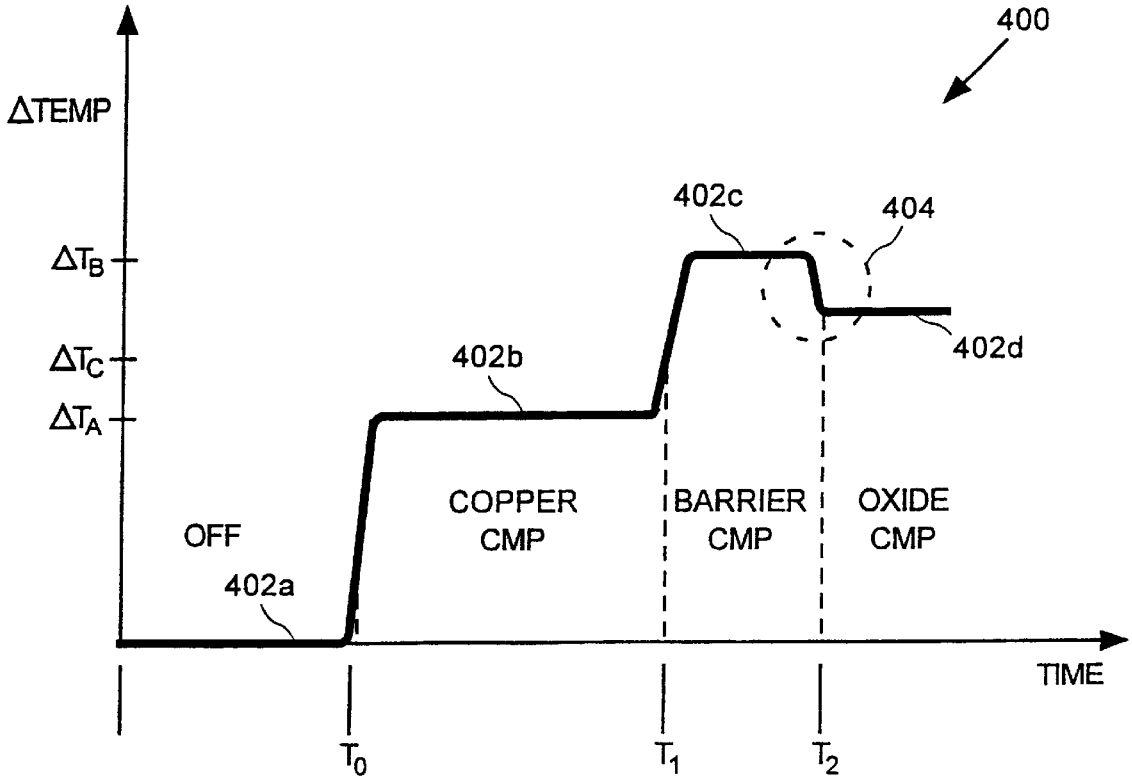
FIGS. 4B and 4C provide a temperature differential versus time plot, in accordance with one embodiment of the present invention.

For illustration purposes, FIG. 4B provides a temperature differential versus time plot 400. The temperature differential versus time plot 400 illustrates a temperature differential change over the pad 304 surface between the sensors 310*a* and 310*b*. For instance, at a time $T_0$, the temperature differential state 402*a* will be zero since the polishing operation has not yet begun. Once the polishing operation begins on the copper material, the temperature differential 402*b* will move up to a temperature differential $\Delta T_A$. This temperature differential is an increase relative to the OFF position because the temperature of the pad 304 increases as the frictional stresses are received by the application of the wafer 301 to the pad 304.

The temperature differential $\Delta T_A$ also increases to a certain level based on the type of material being polished. Once the copper layer 106 is removed from over the structure of FIG. 4A, the CMP operation will continue over the diffusion barrier layer 104. As the diffusion barrier layer material begins to be polished, the temperature differential will move from 402*b* to 402*c*. The temperature differential 402*c* is shown as $\Delta T_B$. This is an increase in temperature differential due to the fact that the diffusion barrier layer 104 is a harder material than the copper layer 106. As soon as the diffusion barrier layer 104 is removed from over the dielectric layer 102, more dielectric material will begin to be polished thus causing another shift in the temperature differential at a time $T_2$.

At this point, the temperature differential 402*d* will be produced at $\Delta T_C$. The shift between $\Delta T_B$ and $\Delta T_C$ will thus define a target end-point temperature differential change 404. This target end-point temperature differential change 404 will occur at about a time $T_2$. In order to ascertain the appropriate time to stop the polishing operation to ensure that the diffusion barrier layer 104 is adequately removed from over the dielectric layer 102, an examination of the transition between 402*c* and 402*d* is preferably made.

Figure 4C:
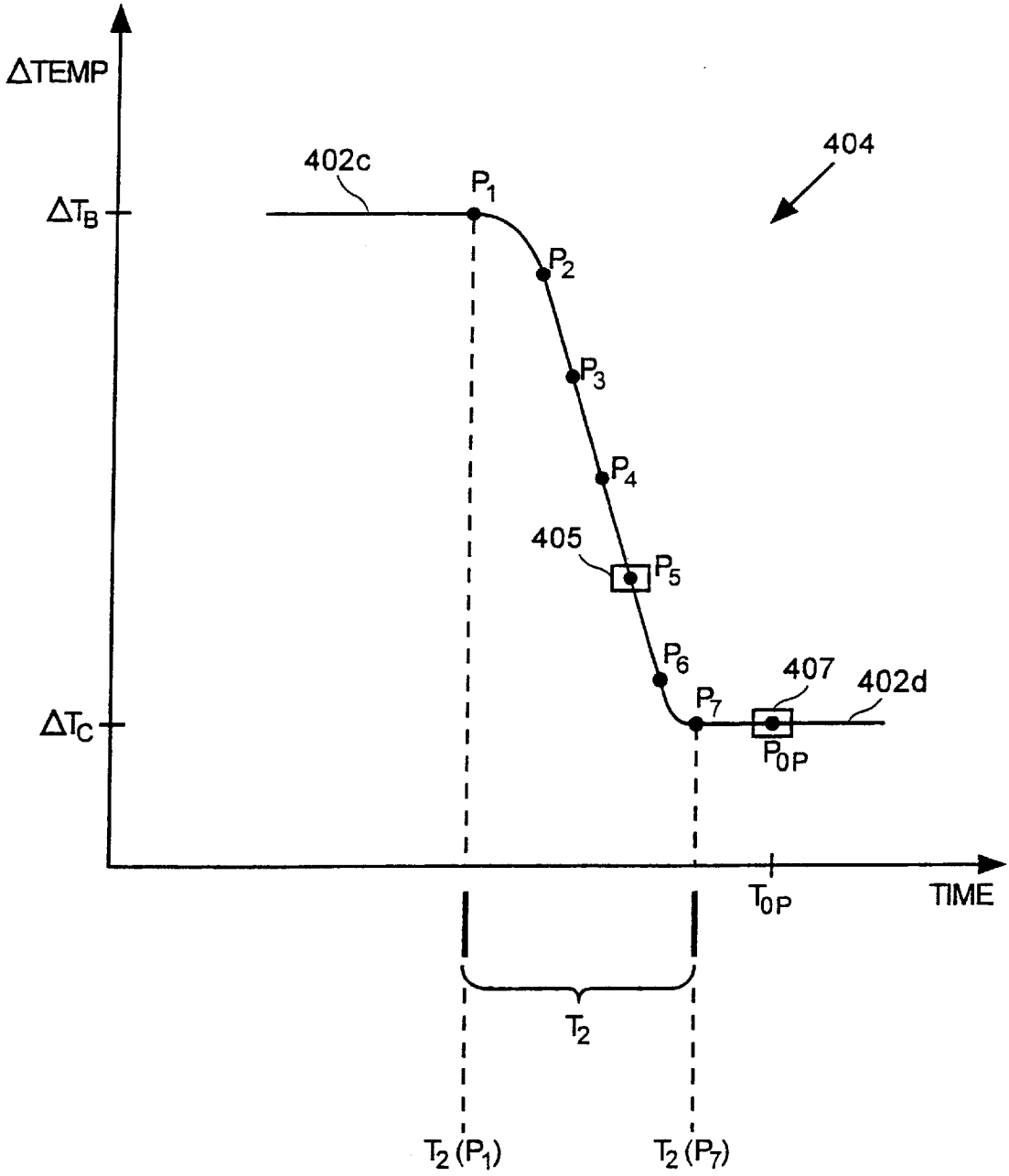

As shown in FIG. 4C, the target end-point temperature differential change 404 is shown in magnification wherein tests were made at several points $P_1$, $P_2$, $P_3$, $P_4$, $P_5$, $P_6$, and $P_7$. These points span the temperature differential $\Delta T_B$ and $\Delta T_C$. As shown, time $T_2$ actually spans between a time $T_2(P_1)$, and a time $T_2(P_7)$. To ensure the best and most accurate end-point, it is necessary to ascertain at what time to stop within time $T_2$. The different points $P_1$ through $P_7$ are preferably analyzed by polishing several test wafers having the same materials and layer thicknesses. By examining the different layers being polished for different periods of time as well as the thicknesses of the associated layers, it is possible to ascertain a precision time at which to stop the polishing operation. For instance, the polishing operation may be stopped at a point $P_5$ 405 instead of a point $P_{OP}$ 407, which defines an over-polish time. The over-polishing technique is typically used in the prior art when it is uncertain when the diffusion barrier layer or any other layer being polished has, in fact, been removed from over the base layer (e.g., dielectric layer).

However, by inspecting the transition between time differential 402*c* and time differential 402*d*, it is possible to ascertain the proper time to stop the polishing operation (thus detecting an exact or nearly exact end-point) within a window that avoids the aforementioned problems of dishing and other over-polishing damage than can occur to sensitive interconnect metallization lines or features.

Figures 5A, 5B:
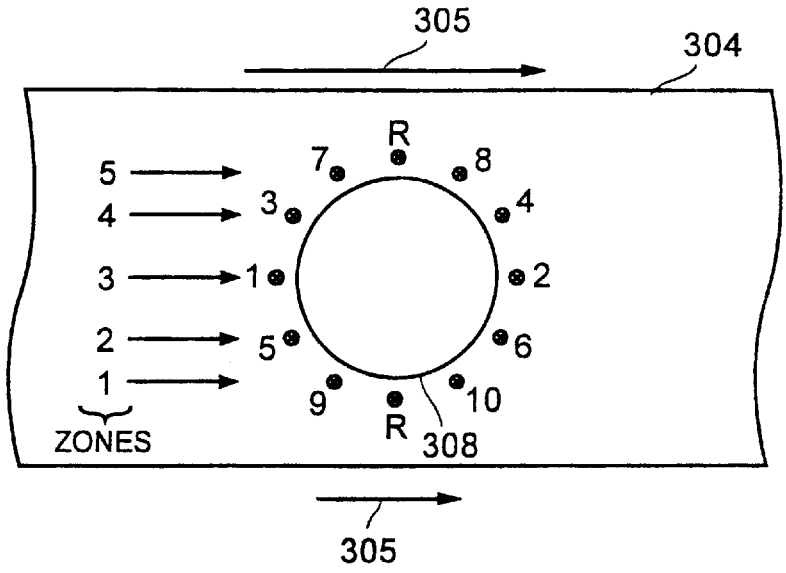
FIG. 5A illustrates a top view diagram of another embodiment of the present invention in which a plurality of sensors 1 through 10 and a pair of reference sensors R are arrange around and proximate to a carrier (therefore, any number of pairs of sensors can be used depending upon the application).
FIG. 5B illustrates a table having target temperature differentials for each zone of a wafer, in accordance with one embodiment of the present invention.

FIG. 5A illustrates a top view diagram of another embodiment of the present invention in which a plurality of sensors 1 through 10 and a pair of reference sensors R are arrange around and proximate to the carrier 308. However, it should be understood that any number of pairs of sensors can also be used. In this embodiment, the sensors are divided into five zones over the wafer being polished. As the pad rotates in the direction 305, temperature differentials are determined between sensors 9 and 10, 5 and 6, 1 and 2, 3 and 4, and 7 and 8. Each of these temperature differentials $\Delta T_1$ through $\Delta T_5$ define zones 1 through 5, respectively. For each of these zones, there is a determined target temperature differential for ascertaining end-point.

By calibrated tests, it may be determined that target temperature differentials for each zone may vary as shown in FIG. 5B. For instance, zones 1 and 5 may have a target temperature differential of 15, zones 2 and 4 may have a temperature differential target about 20, and zone 3 may have a temperature differential of about 35. By examining the temperature differentials in each of the zones, it is possible to ascertain whether the proper end-point has been reach for the different zones of the wafer being polished in FIG. 5A. Accordingly, the embodiments of FIGS. 3 through 4 are equally applicable to the embodiment of FIGS. 5A and 5B. However, by analyzing different zones of the wafer surface, it is possible to ascertain more precise end-point over the different zones of a given wafer. Of course, more or less sensors may be implemented depending upon the number of zones desired to be monitored.

Figure 6:
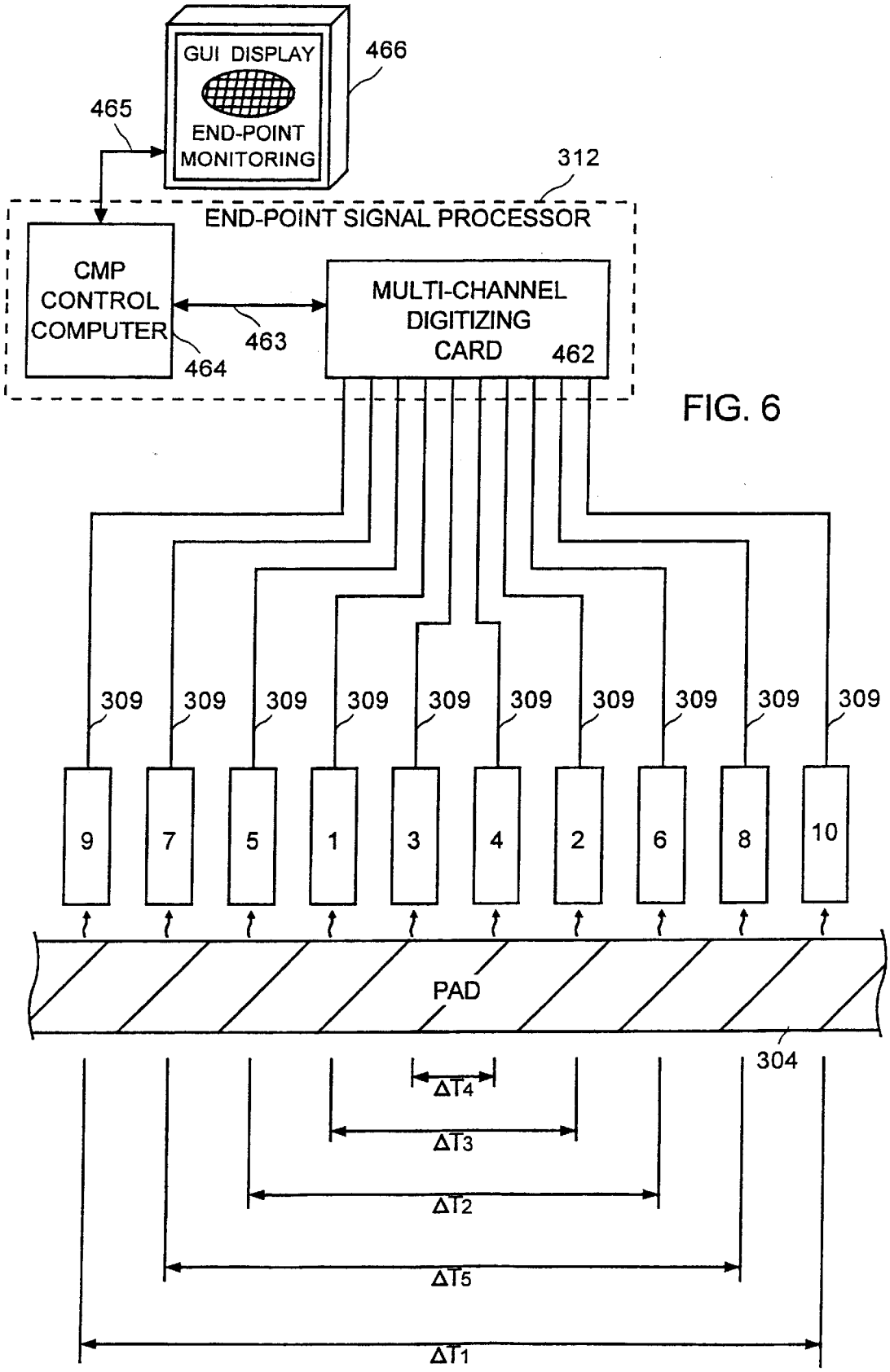
FIG. 6 illustrates a schematic diagram of the sensors 1 through 10 shown in FIG. 5A.

FIG. 6 illustrates a schematic diagram of the sensors 1 through 10 shown in FIG. 5A. The sensors 1 through 10 (e.g., such as sensors 110*a* and 110*b* of FIG. 30 are arranged in a position that is proximate to the pad but in a stationary position that does not rotate as does the carrier 308. By determining the temperature at the different locations over the pad 304 as a polishing operation is in progress, the temperature differentials $\Delta T_1$ through $\Delta T_5$ can be ascertained at the different relative locations of the pad 304. The sensed signals 309 are then communicated to the end-point signal processor 312.

The end-point signal processor 312 is configured to include a multi-channel digitizing card 462 (or digitizing circuit). Multi-channel digitizing card 462 is configured to sample each of the signals and provide an appropriate output 463 to a CMP control computer 464. The CMP control computer 464 can then process the signals received from the multi-channel digitizing card 462 and provide them over a signal 465 to a graphical display 466. The graphical display 466 may include a graphical user interface (GUI) that will illustrate pictorially the different zones of the wafer being polished and signify when the appropriate end-point has been reached for each particular zone. If the end-point is being reached for one zone before another zone, it may be possible to apply appropriate back pressure to the wafer or change the polishing pad back pressure in those given locations in which polishing is slow in order to improve the uniformity of the CMP operation and thus enable the reaching of an end-point throughout the wafer in a uniform manner (i.e., at about the same time).

As can be appreciated, the end-point monitoring of the present invention has the benefit of allowing more precision CMP operations over a wafer and zeroing on selected regions of the wafer being polished to ascertain whether the desired material has been removed leaving the under surface in a clean, yet unharmed condition. It should also be noted that the monitoring embodiments of the present invention are also configured to be non-destructive to a wafer that may be sensitive to photo-assisted corrosion as described above. Additionally, the embodiments of the present invention do not require that a CMP pad be altered by pad slots or the need to drill slots into a platen or a rotary table that is positioned beneath a pad. Thus, the monitoring is more of a passive monitoring that does not interfere with the precision polishing of a wafer, yet provides very precise indications of end-point to precisely discontinue polishing.

While this invention has been described in terms of several preferred embodiments, it will be appreciated that those skilled in the art upon reading the preceding specification and studying the drawings will realize various alterations, additions, permutations and equivalents thereof. For example, the end-point detection techniques will work for any polishing platform (e.g. belt, table, rotary, orbital, etc.) and for any size wafer or substrate, such as, 200 mm, 300 mm, and larger, as well as other sizes and shapes. It is therefore intended that the present invention includes all such alterations, additions, permutations, and equivalents that fall within the true spirit and scope of the invention.

What is claimed is:

1. A method for monitoring a process state of a wafer surface during chemical mechanical polishing, comprising:

providing a polishing pad belt that is configured to move linearly;

applying a wafer to the polishing pad belt at a polishing location so as to remove a first layer of material from the wafer;

sensing a first temperature of the polishing pad belt at an IN location that is linearly before the polishing location;

sensing a second temperature of the polishing pad belt at an OUT location that is linearly after the polishing location;

calculating a temperature differential between the second temperature and the first temperature; and monitoring a change in the temperature differential, the change being indicative of a removal of the first layer from the wafer.

2. A method for monitoring a process state of a wafer surface during chemical mechanical polishing as recited in claim 1, further comprising:

generating a temperature differential table, the temperature differential table including a plurality of temperature differentials wherein each temperature differential is associated with a material type to be polished from the wafer.

3. A method for monitoring a process state of a wafer surface during chemical mechanical polishing as recited in claim 2, wherein the change in temperature differential further indicates a change in the removal of the first layer being of first type of material to another layer being of a second type of material.

4. A method for monitoring a process state of a wafer surface during chemical mechanical polishing as recited in claim 3, wherein the first type of material is a metallization material and the second type of material is a barrier material.

5. A method for monitoring a process state of a wafer surface during chemical mechanical polishing as recited in claim 3, wherein the first type of material is a diffusion barrier material and the second type of material is an dielectric material.

6. A method for monitoring a process state of a wafer surface during chemical mechanical polishing as recited in claim 1, wherein the sensing includes infrared temperature sensing.

7. A method for monitoring a process state of a wafer surface during chemical mechanical polishing as recited in claim 1, further comprising:

sensing a plurality of additional pairs of locations, each of the additional pairs of locations including a first point that is before the polishing location and a second point that is after the polishing location.

8. A method for monitoring a process state of a wafer surface during chemical mechanical polishing as recited in claim 7, wherein each of the additional pairs of locations are configured to provide end-point detection over an associated plurality of zones of the wafer.

9. A method for monitoring a process state of a wafer surface for purposes of switching to another wafer preparation phase or finishing a chemical mechanical planarization process, comprising:

providing a polishing pad that is configured to move linearly;

applying a wafer to the polishing pad at a polishing location so as to remove a layer of material from the wafer;

sensing a first temperature of the polishing pad at a first location that is before the polishing location;

sensing a second temperature of the polishing pad at a second location that is after the polishing location; and calculating a temperature differential between the second temperature and the first temperature.

10. A method for monitoring a process state of a wafer surface for purposes of switching to another wafer preparation phase or finishing a chemical mechanical planarization process as recited in claim 9, further comprising:

monitoring a change in the temperature differential, the change being indicative of a removal of the layer from the wafer.

11. A method for monitoring a process state of a wafer surface for purposes of switching to another wafer preparation phase or finishing a chemical mechanical planarization process as recited in claim 10, wherein the change in temperature differential further indicates a change in the removal of the layer being of first type of material to another layer being of a second type of material.

12. An end-point detection method, comprising:

providing a polishing pad;

applying a wafer to the polishing pad at a polishing location so as to remove a first layer of material from the wafer;

sensing a first temperature of the polishing pad at an IN location that is before the polishing location;

sensing a second temperature of the polishing pad at an OUT location that is after the polishing location;

calculating a temperature differential between the second temperature and the first temperature; and monitoring a change in the temperature differential, the change being indicative of a removal of the first layer from the wafer.

13. An end-point detection method as recited in claim 12, wherein the pad is one of a belt pad, a table pad, a rotary pad, and an orbital pad.

* * * * *